US010716451B2

(12) United States Patent
Isbilen et al.

(10) Patent No.: US 10,716,451 B2
(45) Date of Patent: Jul. 21, 2020

(54) LIFTING DEVICE, METHOD FOR OPERATING A LIFTING DEVICE, AND DISH WASHING MACHINE

(71) Applicant: BSH Hausgeräte GmbH, Munich (DE)

(72) Inventors: Ersin Isbilen, Lauingen (DE); Hans-Holger Pertermann, Dresden (DE); Martin Rittner, Welden (DE); Thomas Steck, Holzheim (DE); Christian Wolf, New Bern, NC (US)

(73) Assignee: BSH Hausgeräte GmbH, Munich (DE)

( * ) Notice: Subject to any disclaimer, the term of this patent is extended or adjusted under 35 U.S.C. 154(b) by 296 days.

(21) Appl. No.: 15/774,599

(22) PCT Filed: Dec. 21, 2016

(86) PCT No.: PCT/EP2016/082075
§ 371 (c)(1),
(2) Date: May 9, 2018

(87) PCT Pub. No.: WO2017/108889
PCT Pub. Date: Jun. 29, 2017

(65) Prior Publication Data

US 2018/0325353 A1 Nov. 15, 2018

(30) Foreign Application Priority Data

Dec. 22, 2015 (DE) ..... 10 2015 226 559

(51) Int. Cl.
*A47L 15/50* (2006.01)
*A47L 15/00* (2006.01)
(Continued)

(52) U.S. Cl.
CPC ..... *A47L 15/506* (2013.01); *A47L 15/0049* (2013.01); *A47L 15/28* (2013.01);
(Continued)

(58) Field of Classification Search
CPC ..... A47L 2501/36; A47L 15/506; A47L 2401/30; A47L 15/4295; A47L 2401/34;
(Continued)

(56) References Cited

U.S. PATENT DOCUMENTS 8,931,755 B2 * 1/2015 Staffiere ..... F16K 31/055 251/129.11
9,420,882 B2 8/2016 Garcia et al.
(Continued)

FOREIGN PATENT DOCUMENTS

DE 102013226910 A1 * 6/2015 ..... A47L 15/506
EP 0962183 A1 12/1999
(Continued)

OTHER PUBLICATIONS

Translation of JP 2006 141700. (Year: 2006).*
(Continued)

*Primary Examiner* — Alexander Markoff
(74) *Attorney, Agent, or Firm* — Michael E. Tschupp; Andre Pallapies; Brando G. Braun

(57) ABSTRACT

A lifting device for a dishwashing machine includes an electrical drive mechanism constructed to move a dishware receptacle of the dishwashing machine between a start position and an end position. A detection unit detects a current draw of the electrical drive mechanism over a travel distance of the dishware receptacle in the dishwashing machine, and an identification unit identifies a status of the lifting device on the basis of the current draw of the electrical drive mechanism detected over the travel distance.

17 Claims, 6 Drawing Sheets

(51) Int. Cl.
*A47L 15/28* (2006.01)
*A47L 15/42* (2006.01)

(52) U.S. Cl.
CPC ..... *A47L 15/4295* (2013.01); *A47L 2401/04* (2013.01); *A47L 2401/30* (2013.01); *A47L 2401/34* (2013.01); *A47L 2501/36* (2013.01)

(58) Field of Classification Search
CPC ... A47L 15/0049; A47L 2401/04; A47L 15/28
See application file for complete search history.

(56) References Cited

U.S. PATENT DOCUMENTS

| | | | | |
|---|---|---|---|---|
| 9,549,660 | B2 | 1/2017 | Park et al. | |
| 9,872,597 | B2 * | 1/2018 | Pers | A47L 15/0049 |
| 2010/0212704 | A1 * | 8/2010 | Kan | D06F 39/02 134/56 R |
| 2012/0074080 | A1 | 3/2012 | Garcia et al. | |
| 2012/0132838 | A1 * | 5/2012 | Staffiere | F16K 31/05 251/129.01 |
| 2014/0230856 | A1 * | 8/2014 | Sundaram | A47L 15/428 134/18 |
| 2016/0309982 | A1 * | 10/2016 | Gerstner | A47L 15/506 |
| 2016/0331205 | A1 * | 11/2016 | Gerstner | A47L 15/506 |
| 2016/0331206 | A1 * | 11/2016 | Gerstner | A47L 15/506 |
| 2017/0027413 | A1 * | 2/2017 | Gerstner | A47L 15/506 |
| 2018/0168429 | A1 * | 6/2018 | Rittner | A47L 15/46 |
| 2018/0325353 | A1 * | 11/2018 | Isbilen | A47L 15/506 |

FOREIGN PATENT DOCUMENTS

| | | | |
|---|---|---|---|
| JP | 2006141700 | A | 6/2006 |
| WO | 2014102367 | A1 | 7/2014 |
| WO | 2014102374 | A1 | 7/2014 |

OTHER PUBLICATIONS

National Search Report De 10 2015 226 559.5 dated Aug. 23, 2016.
International Search Report PCT/EP2016/082075 dated Feb. 17, 2017.

* cited by examiner

LIFTING DEVICE, METHOD FOR OPERATING A LIFTING DEVICE, AND DISH WASHING MACHINE

CROSS-REFERENCES TO RELATED APPLICATIONS

This application is the U.S. National Stage of International Application No. PCT/EP2016/082075, filed Dec. 21, 2016, which designated the United States and has been published as International Publication No. WO 2017/108889 A1 and which claims the priority of German Patent Application, Serial No. 10 2015 226 559.5, filed Dec. 22, 2015, pursuant to 35 U.S.C. 119(a)-(d).

BACKGROUND OF THE INVENTION

The present invention relates to a lifting device for a dishwashing machine, to a method for operating said lifting device, and to a dishwashing machine comprising said lifting device.

DE 10 2013 226 910 A1 describes a lifting device for a dishware receptacle of a water-holding domestic appliance, wherein the dishware receptacle can optionally be moved into a washing container of the water-holding domestic appliance or out of said washing container, wherein the lifting device is designed to raise the dishware receptacle when it is moved out of the washing container and to lower the dishware receptacle when it is moved into the washing container, wherein the lifting device has a drive mechanism and a controller, wherein the controller is designed to control the drive mechanism during manual movement of the dishware receptacle such that the drive mechanism assists by means of an assist force the manual movement of the dishware receptacle.

DE 10 2012 107 993 A1, DE 20 2009 004 771 U1, EP 2 818 092 A1, WO 2014/102367 A1 and WO 2014/102374 A1 disclose further lifting devices or basket lifting systems.

JP 2006 141700 A discloses an active basket lifting system having an active drive element comprising a motor unit and gear unit. This document describes analyzing the drive current of the drive element over time, wherein fault conditions of the drive element can be inferred from this analysis over time. Examples of said fault conditions include obstruction of the basket or washing container.

BRIEF SUMMARY OF THE INVENTION

Against this background, an object of the present invention is to provide an improved lifting device.

A lifting device is accordingly proposed for a dishwashing machine, in particular a domestic dishwashing machine, comprising a dishware receptacle, wherein the lifting device comprises an electrical drive mechanism that is designed to move the dishware receptacle between a start position and an end position by means of raising or lowering, a detection unit for detecting a current draw of the electrical drive mechanism over a travel distance of the dishware receptacle in the dishwashing machine, and an identification unit for identifying at least one status of the lifting device on the basis of the current draw of the drive mechanism detected over the travel distance.

The travel distance is defined as a distance, in particular as a displacement, between the start position of the dishware receptacle and the end position of the dishware receptacle. Thus the travel distance equals the distance covered by the dishware receptacle during raising and/or lowering between the start position and the end position.

Examples of the at least one status of the lifting device include a present position of the dishware receptacle in the washing container, a fault condition of the lifting device and a present weight of the load of the dishware receptacle. A fault condition of the lifting device exists, for example, when the movement of the dishware receptacle is obstructed.

In the present lifting device, the at least one status is identified by analyzing the current draw of the electrical drive mechanism detected over the travel distance. An analysis over time of the current draw is advantageously not used in this process. Thus the identification unit works independently of the parameter time. In particular, the relationship between current and distance is used to provide position detection and load detection.

This is done without the need to fit any additional sensors in the dishwashing machine. The proposed lifting device advantageously increases the safety of the entire dishwashing machine system.

According to one embodiment, the identification unit is designed to identify, on the basis of the current draw of the drive mechanism detected over the travel distance, a position of the dishware receptacle in a washing container of the dishwashing machine, a fault condition of the lifting device and/or a present weight of a load accommodated in the dishware receptacle.

An example of the fault condition of the lifting device is obstruction of the dishware receptacle during raising or lowering. Such an obstruction may be caused, for instance, by a user or even by a child.

According to a further embodiment, the identification unit is designed to identify a fault condition of the lifting device on the basis of a derivative of the detected current draw with respect to the travel distance.

The current draw of the electrical drive mechanism is a function of the travel distance of the dishware receptacle between the start position and the end position. The derivative here is in particular the first mathematical derivative of this function of the detected current draw with respect to the travel distance. Using the first derivative of this function is a simple and explicit way of identifying fault conditions.

According to a further embodiment, the identification unit is designed to identify the at least one status of the lifting device on the basis of a comparison of the current draw detected over the travel distance with at least one reference curve for the current draw of the electrical drive mechanism.

Using reference curves provides a technically simple implementation for identifying the at least one status of the lifting device.

According to a further embodiment, a memory unit is provided for storing a multiplicity of different reference curves for the current draw of the electrical drive mechanism, which reference curves are weight-specific for the load of the dishware receptacle. The identification unit is designed in this case to determine the present weight of the load accommodated in the dishware receptacle by comparing the detected current draw with the weight-specific reference curves.

For instance, one of the weight-specific reference curves can be selected from the plurality of stored weight-specific reference curves by means of the detected current draw. The selected weight-specific reference curve can be used to infer the weight of the load in the dishware receptacle.

According to a further embodiment, the lifting device comprises a memory unit for storing a multiplicity of different reference curves for the current draw of the electrical drive mechanism, which reference curves are weight-specific for the load of the dishware receptacle, a weight sensor for determining a present weight of the load accommodated in the dishware receptacle, and a selection unit for selecting one of the stored reference curves on the basis of the weight of the load determined by the weight sensor. In this case, the identification unit is designed to identify a fault condition of the lifting device by comparing the detected current draw with the selected reference curve.

The selected reference curve constitutes in particular a reference-value characteristic. In contrast, the detected current draw constitutes an actual-value characteristic. A fault condition of the lifting device can be inferred on the basis of a difference between the actual-value characteristic and the reference-value characteristic.

According to a further embodiment, the lifting device comprises a weight sensor for determining a weight of the load accommodated in the dishware receptacle.

According to a further embodiment, the identification unit is designed to identify the at least one status of the lifting device on the basis of the detected current draw and the weight determined by the weight sensor.

The information content for identifying the at least one status of the lifting device is increased by using the weight determined by the weight sensor in addition to the detected travel-specific current draw. The increase in the information content increases the accuracy and reliability in identifying the at least one status of the lifting device.

According to a further embodiment, a sensor device is provided for detecting the travel distance of the dishware receptacle in the dishwashing machine. The sensor device is preferably designed to detect the travel distance optically, acoustically, magnetically or via a change in an electrical resistance.

According to a further embodiment, the lifting device comprises a memory unit for storing a minimum reference curve for a minimum current draw of the electrical drive mechanism and a maximum reference curve for a maximum current draw of the electrical drive mechanism. In this embodiment, the identification unit is designed to ascertain a fault condition of the lifting device if the detected current draw is less than the stored minimum reference curve or greater than the stored maximum reference curve.

According to a further embodiment, the lifting device comprises a controller which is designed to control the electrical drive mechanism for raising or lowering the dishware receptacle according to the identified at least one status of the lifting device.

In particular, the controller can be designed as the central control unit of the dishwashing machine. It can also be referred to as the electronics unit or central electronics unit of the dishwashing machine.

According to a further embodiment, the identification unit is integrated in the controller.

According to a further embodiment, the electrical drive mechanism has a servomotor. A servomotor is a generic term for a specific embodiment of an electric motor in which a sensor device is present that allows a position of the shaft of the electric motor to be detected. In particular, the drive mechanism can be a servomotor. Precise control of the drive mechanism is thereby possible, because the servomotor can constantly transmit to the controller a rotational position of a drive shaft of said servomotor.

According to a further embodiment, the servomotor is arranged in, or on, a side wall of the dishwashing machine.

The servomotor is preferably arranged between a side wall of the washing container and the side wall of the dishwashing machine. In particular, the controller is also positioned on, or in, the side wall of the dishwashing machine. This results in a particularly space-saving design of the lifting device.

According to a further embodiment, the lifting device is designed for a dishwashing machine comprising a top dishware receptacle and a bottom dishware receptacle. In this embodiment, the electrical drive mechanism is designed to move the bottom dishware receptacle between the start position and the end position by means of raising or lowering, wherein the sensor device is designed to detect the travel distance of the bottom dishware receptacle in the dishwashing machine, wherein the detection unit is designed to detect the current draw of the electrical drive mechanism over the travel distance of the bottom dishware receptacle, and wherein the identification unit is designed to identify the at least one status of the lifting device on the basis of the current draw of the electrical drive mechanism detected over the travel distance of the bottom dishware receptacle.

The top dishware receptacle is provided in the washing container of the dishwashing machine above the bottom dishware receptacle. A cutlery drawer of the dishwashing machine may be arranged above the top dishware receptacle. The drive mechanism is preferably designed automatically to raise the bottom dishware receptacle from the start position into the end position, and to lower same from the end position into the start position. In other words, the bottom dishware receptacle is moved without a manual actuating force being applied thereto. The fact that the lifting device can be operated only by applying the actuating force to the top dishware receptacle means that it is not necessary for a user to bend down to the bottom dishware receptacle to operate the lifting device. This increases the operating convenience.

In particular, a speed of movement of the bottom dishware receptacle during raising or lowering thereof is proportional to a variation in the actuating force. For example, the speed of movement is directly proportional to the variation in the actuating force. In other words, the greater the actuating force and/or the further the top dishware receptacle is pushed into the washing container or pulled out of the washing container, the greater the speed of movement of the bottom dishware receptacle.

The lifting device preferably also comprises at least one pivoting arm, which is pivotably attached to the washing container of the dishwashing machine and to the dishware receptacle. The washing container is preferably assigned four such pivoting arms, which are arranged in pairs on each side of the washing container. In particular, the pivoting arms are pivotably arranged on a guidance mechanism to which is attached the bottom dishware receptacle. In particular, the drive mechanism is arranged on the at least one pivoting arm. The drive mechanism preferably has a drive shaft, which passes through a side wall of the washing container. A suitable sealing mechanism can be provided between the drive shaft and the side wall. The drive shaft is connected to a bearing of the pivoting arm for conjoint rotation. Said drive mechanism can preferably be provided on each side of the bottom dishware receptacle. Optionally, said drive mechanism can be provided on each of the pivoting arms.

In addition, the controller is preferably designed to control the drive mechanism such that the bottom dishware receptacle remains in its present position on removal of the actuating force.

The top dishware receptacle can be moved into the washing container or moved out of said washing container by applying the actuating force, in particular a pushing force or a pulling force. As soon as the manual actuating force is no longer acting on the top dishware receptacle, the bottom dishware receptacle automatically remains in its present position. This can prevent injury to the user by an unintentional movement of the bottom dishware receptacle.

The controller is preferably designed to control the drive mechanism to raise the bottom dishware receptacle when the top dishware receptacle is moved inwards into the washing container. The controller is also designed to control the drive mechanism to lower the bottom dishware receptacle when the top dishware receptacle is moved outwards out of the washing container.

In other words, the bottom dishware receptacle is raised when the top dishware receptacle is moved inwards into the washing container or when the actuating force in the form of a pushing force is applied to the top dishware receptacle in the direction into the washing container, and the bottom dishware receptacle is lowered when the top dishware receptacle is moved outwards out of the washing container or when the actuating force in the form of a pulling force is applied to the top dishware receptacle in the direction out of the washing container.

According to a further embodiment, the lifting device comprises a locking mechanism, which is designed to lock the top dishware receptacle during raising or lowering of the bottom dishware receptacle such that this top dishware receptacle is fixed in the washing container in a linearly immovable manner.

This ensures that the top dishware receptacle always remains in the washing container during raising or lowering of the bottom dishware receptacle. This prevents the bottom dishware receptacle from colliding with the top dishware receptacle.

According to a further embodiment, the locking mechanism is designed to release the top dishware receptacle only when the bottom dishware receptacle is located in the start position.

The position of the bottom dishware receptacle can be detected using suitable sensors. Only in the start position can the bottom dishware receptacle be moved into the washing container or out of the washing container.

According to a further embodiment, the locking mechanism is designed to connect the top dishware receptacle to the washing container in order to lock said receptacle in place.

The locking mechanism is designed in particular to connect the top dishware receptacle interlockingly to the washing container. The locking mechanism can have a locking element such as a pin, for instance, that can be displaced using a solenoid. The locking element can be designed to engage interlockingly into a mating segment provided on the washing container. The locking element may also be an electromagnet, for example.

According to a further embodiment, the lifting device comprises a spring mechanism, which is designed to connect the locking mechanism to the top dishware receptacle.

The spring mechanism may be a helical spring or a cylindrical spring. The spring mechanism is preferably positioned between the top dishware receptacle and the locking mechanism.

During lowering of the bottom dishware receptacle, the manual actuating force acts against the spring force of the spring mechanism such that the spring mechanism is compressed. During raising of the bottom dishware receptacle, the manual actuating force acts against the spring force of the spring mechanism such that the spring mechanism is extended.

A dishwashing machine comprising a washing container, in which a dishware receptacle can be arranged, and comprising a lifting device as described above is also proposed. In particular, the dishwashing machine is a domestic dishwashing machine.

The bottom dishware receptacle can also be referred to as a bottom basket, and the top dishware receptacle also as a top basket.

In addition, a method is proposed for operating a lifting device for a dishwashing machine, in particular a domestic dishwashing machine, comprising a dishware receptacle, wherein the lifting device has an electrical drive mechanism that is designed to move the dishware receptacle between a start position and an end position by means of raising or lowering. The method comprises the following steps: detecting a travel distance of the dishware receptacle in the dishwashing machine, detecting a current draw of the electrical drive mechanism over the travel distance, and identifying at least one status of the lifting device on the basis of the current draw of the drive mechanism detected over the travel distance.

The embodiments and features described for the proposed device apply correspondingly to the proposed method.

In addition, a computer program product is proposed which causes the method, as described above, to be carried out on a programmable device.

A computer program product such as e.g. a computer program means, for example can be provided or supplied as a storage medium such as e.g. a memory card, USB stick, CD-ROM, DVD, or even in the form of a downloadable file by a server in a network. This can be done, for example, in a wireless communications network by transmitting a suitable file containing the computer program product or the computer program means.

Further possible implementations of the invention also include combinations of features or embodiments described above or below with regard to exemplary embodiments, even if these combinations are not mentioned explicitly. A person skilled in the art will also add individual aspects as improvements or additions to the relevant basic form of the invention.

BRIEF DESCRIPTION OF THE DRAWINGS

Further advantageous embodiments and aspects of the invention form the subject matter of the dependent claims and of the exemplary embodiments of the invention that are described below. The invention is described in greater detail below using preferred embodiments with reference to the accompanying figures.

DETAILED DESCRIPTION OF EXEMPLARY EMBODIMENTS OF THE PRESENT INVENTION

In the figures, elements that are identical or have the same function are denoted by the same reference signs unless otherwise stated.

Figure 1:
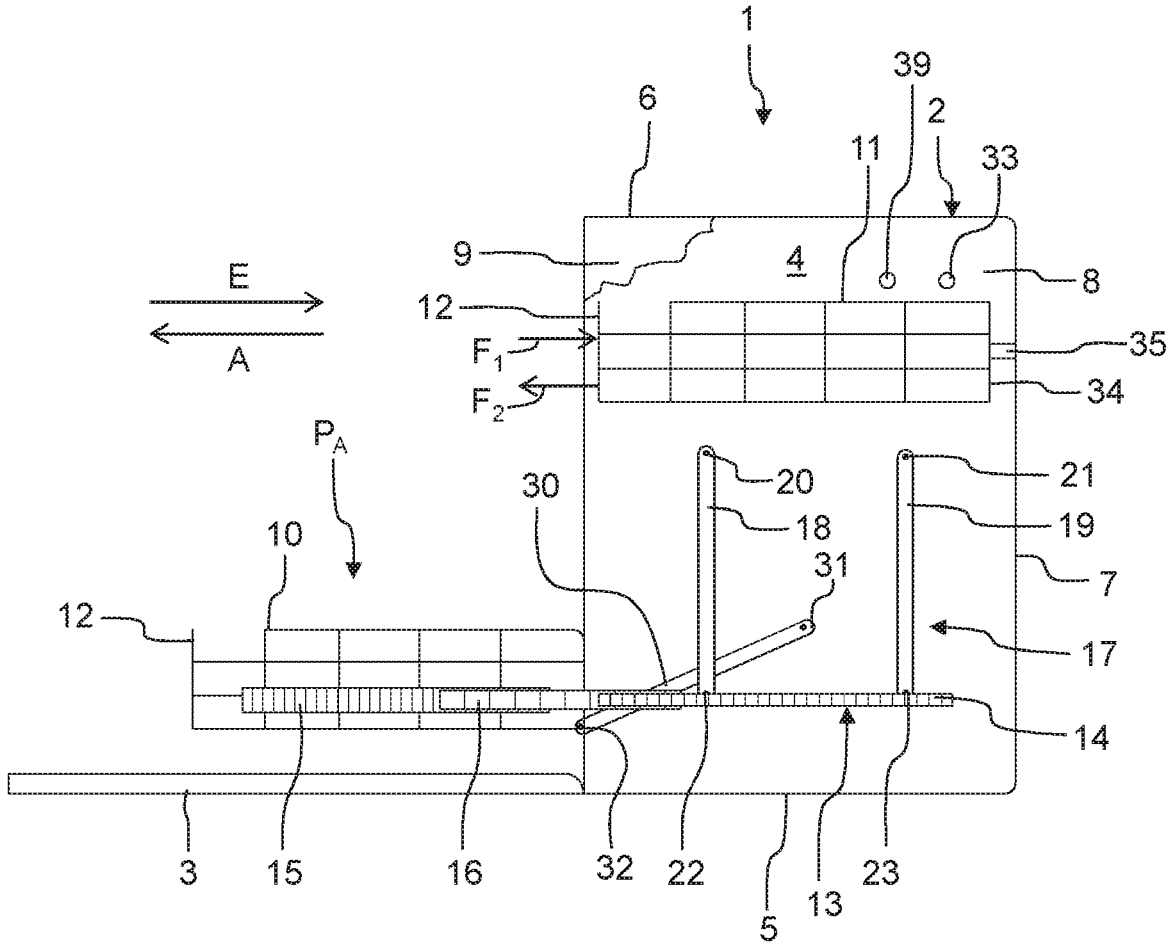
FIG. 1 is a schematic sectional view of an embodiment of a dishwashing machine.
Figure 2:
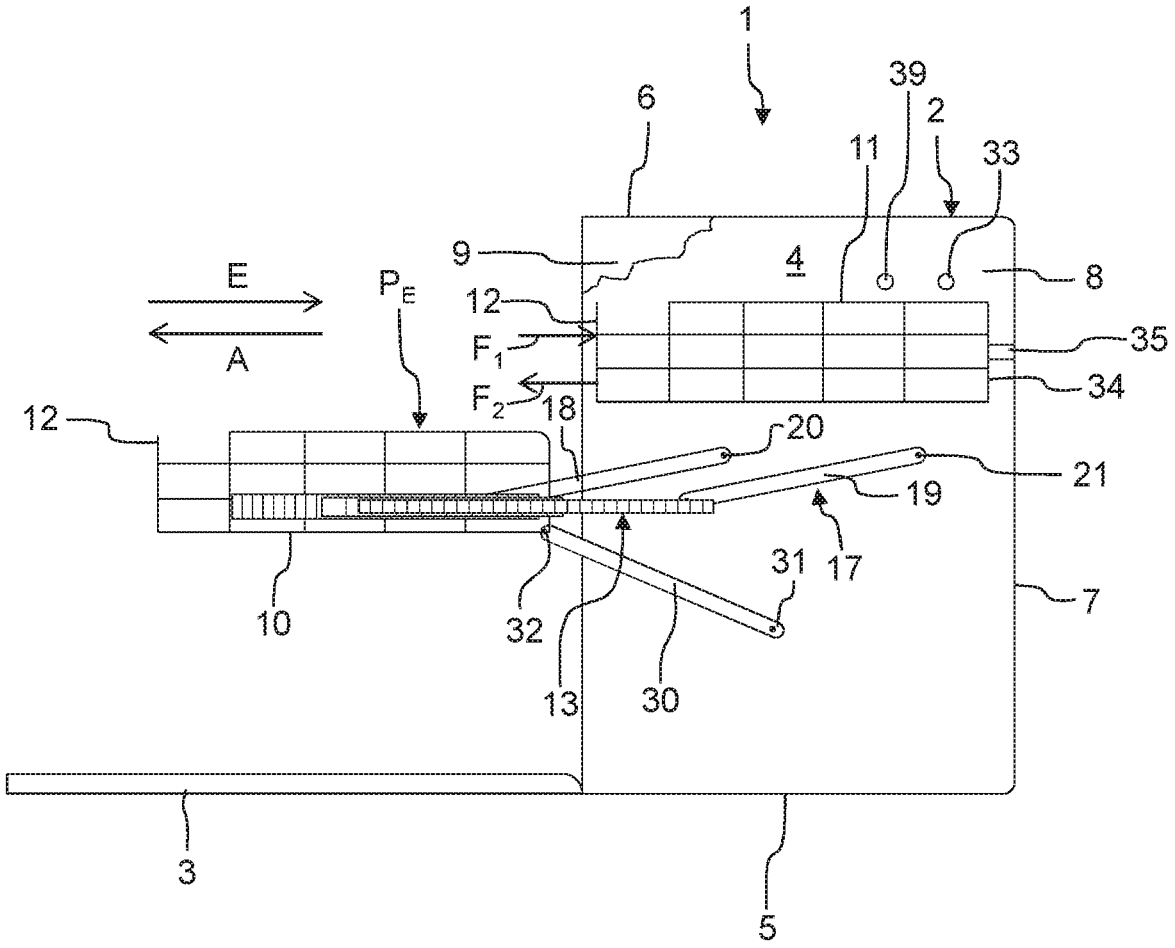
FIG. 2 is another schematic sectional view of the dishwashing machine shown in FIG. 1.

FIGS. 1 and 2 each show a schematic sectional view of an embodiment of a dishwashing machine 1. The dishwashing machine 1 is preferably a domestic dishwashing machine. The dishwashing machine 1 has a washing container 2, which can be closed by a door 3, in particular in a watertight manner. A sealing means can be provided for this purpose between the door 3 and the washing container 2. The washing container 2 and the door 3 can form a washing chamber 4 of the dishwashing machine 1 for washing dishware. FIGS. 1 and 2 show the door 3 in its open position. The door 3 can be closed or opened by pivoting about a pivot axis provided on the bottom end of the door 3.

The washing container 2 has a floor 5, a ceiling 6 arranged opposite the floor 5, and a rear wall 7 arranged opposite the door 3. The washing container 2 also has two side walls 8, 9 arranged opposite each other. FIGS. 1 and 2 show only a portion of the side wall 9. The washing container 2 is preferably cuboid in shape. The washing container 2 is preferably made from a metal material, in particular from a sheet metal. For instance, the washing container 2 can be made from a stainless steel sheet. It is also possible for the floor 5 to be made from a plastics material.

The dishwashing machine 1 has a bottom basket or a bottom dishware receptacle 10. The dishwashing machine 1 also has a top basket or a top dishware receptacle 11. The dishware receptacles 10, 11 are preferably arranged one above the other in the washing container 2. In the orientation shown in FIGS. 1 and 2, the top dishware receptacle 11 is arranged above the bottom dishware receptacle 10. In addition, the dishwashing machine 1 can comprise a cutlery drawer (not shown) above the top dishware receptacle 11. The dishware receptacles 10, 11 are preferably box-shaped. Floors and walls of the dishware receptacles 10, 11 are in the form of mesh. Each dishware receptacle 10, 11 can be moved optionally into the washing container 2 in an insertion direction E or out of said washing container in an extraction direction A opposite to the insertion direction E. A handle 12 can be provided on each of the dishware receptacles 10, 11.

Guidance mechanisms 13 can be used for this to move the dishware receptacles 10, 11 into the washing container 2 or out of said washing container. FIGS. 1 and 2 show only the guidance mechanism 13 of the bottom dishware receptacle 10. Each dishware receptacle 10, 11 is preferably allocated two such guidance mechanisms 13, which are arranged on each side of the dishware receptacles 10, 11. The dishware receptacles 10, 11 can each be mounted in their allocated guidance mechanisms 13. Each guidance mechanism 13 can have a first guide rail 14, a second guide rail 15 and a running rail 16, which is arranged between the first guide rail 14 and the second guide rail 15. The bottom dishware receptacle 10 is preferably attached to the second guide rail 15 and/or mounted therein. The running rail 16 can move relative to the guide rails 14, 15.

The dishwashing machine 1 also comprises a lifting device 17 for the bottom dishware receptacle 10. The lifting device 17 is designed to move the bottom dishware receptacle 10, when it is positioned fully extracted from the washing container 2, from a start position $P_A$ shown in FIG. 1 into an end position $P_E$ shown in FIG. 2. In other words, only in the start position $P_A$ can the bottom dishware receptacle 10 be moved into the washing container 2 or out of the washing container. In particular, the lifting device 17 is designed to raise the bottom dishware receptacle 10 from the start position $P_A$ into the end position $P_E$, and to lower said dishware receptacle from the end position $P_E$ into the start position $P_A$.

The lifting device 17 comprises at least a first pivoting arm 18 and a pivoting arm 19, which is spaced apart from the first pivoting arm 18. Each of the pivoting arms 18, 19 is pivotably attached by a bearing 20, 21 respectively to one of the side walls 8, 9 of the washing container 2. In particular, the bearings 20, 21 are fixed bearings. The bearing 20 is preferably arranged here at the same height as the bearing 21 in the vertical direction. The pivoting arms 18, 19 are also pivotably attached by bearings 22, 23 to the guidance mechanism 13 of the bottom dishware receptacle 10 and in particular to the first guide rail 14. In FIG. 1, the pivoting arms 18, 19 are positioned vertically. In other words, in the start position $P_A$ of the bottom dishware receptacle 10, the pivoting arms 18, 19 are in a vertical arrangement.

Figure 3:
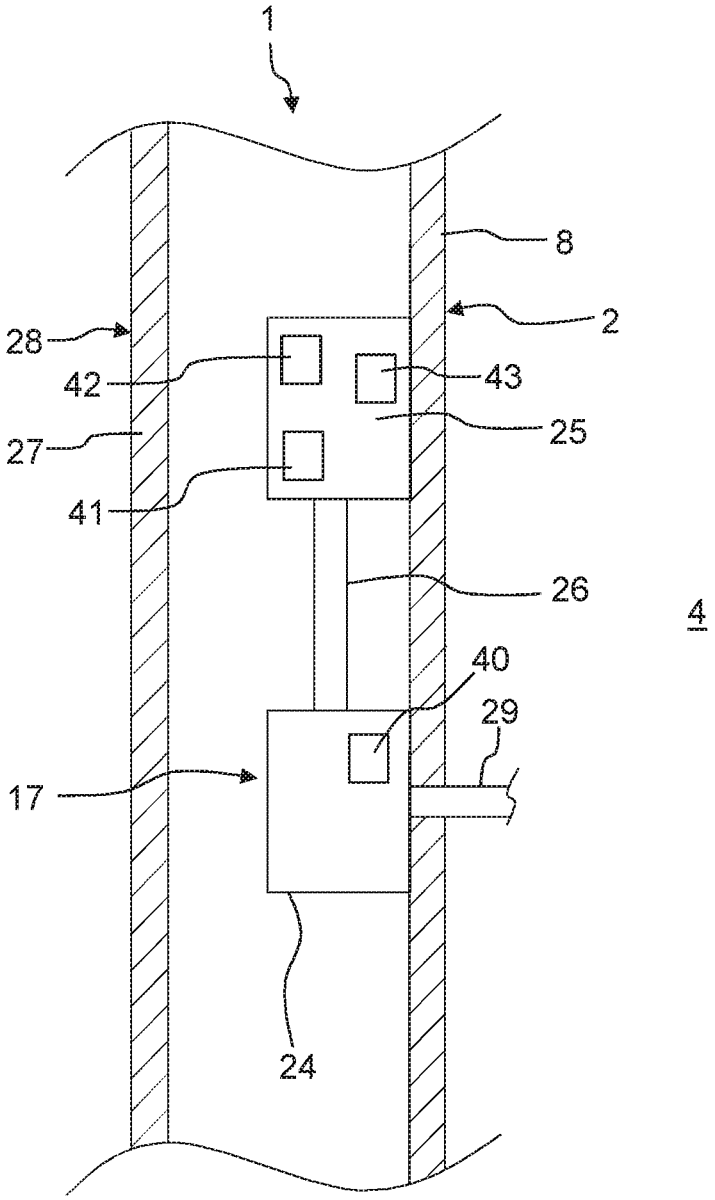
FIG. 3 is a schematic partial sectional view of the dishwashing machine shown in FIG. 1.

The lifting device 17 also comprises an electrical drive mechanism 24 shown in FIG. 3 and a controller 25, which can be connected to the drive mechanism 24 via a control line 26. The drive mechanism 24 comprises a servomotor or is embodied as a servomotor. A power supply to the drive mechanism 24 can also be provided via the control line 26. The drive mechanism 24 and/or the controller 25 are arranged in, or on, a side wall 27 of a housing 28 of the dishwashing machine 1. As FIG. 3 shows, the drive mechanism 24 and the controller 25 are positioned between the side wall 8 of the washing container 2 and the side wall 27 of the housing 28 of the dishwashing machine 1. The controller 25 can also be integrated in the drive mechanism 24. This results in a particularly compact design of the lifting device 17.

The drive mechanism 24 comprises a drive shaft 29, which passes through the side wall 8 of the washing container 2 into the washing chamber 4. A suitable sealing mechanism can be provided between the drive shaft 29 and the side wall 8. The drive shaft 29 is preferably connected to the bearing 20 of the first pivoting arm 18 for conjoint rotation with said arm, so that the drive mechanism 24 can apply a torque to the first pivoting arm 18. Alternatively or additionally, such a drive mechanism 24 can also be provided for the second pivoting arm 19. Such drive mechanisms 24 can be provided on both side walls 8, 9 of the washing container 2. The drive mechanism 24 is designed to raise from the start position $P_A$ into the end position $P_E$, or to lower from the end position $P_E$ into the start position $P_A$, the bottom dishware receptacle 10 without a manual assist force.

Returning now to FIGS. 1 and 2, the lifting device 17 also comprises a control lever or drag lever 30. Said drag lever 30 is preferably provided on each side of the bottom dishware receptacle 10. The drag lever 30 is rotatably mounted by a bearing 31 on the washing container 2, and in particular one drag lever on each of the side walls 8, 9. Said bearing 31 is arranged below the bearings 20, 21 of the pivot arms 18, 19 in the vertical direction. In addition, the drag lever 30 is mounted by a bearing 32 on the bottom dishware receptacle 10. The drag lever 30 can be designed to lock the bottom dishware receptacle 10 during raising or lowering such that it cannot be moved into the washing container 2 or out of the washing container. The drag lever 30 can comprise a catch or locking mechanism for this purpose. In particular, the drag lever 30 can be designed to lock the bearing 32 of the drag lever 30, which bearing is provided on the bottom dishware receptacle 10, during raising and lowering of the bottom dishware receptacle 10, so that the bearing 32 can pivot, but not move linearly, relative to the bottom dishware receptacle 10. In other words, during raising or lowering of the bottom dishware receptacle 10, the bearing 32 is able only to pivot relative to the bottom dishware receptacle 10. Only in the start position $P_A$ is the bearing 32 released so that the bottom dishware receptacle 10 can move linearly relative to the bearing 32. The drag lever 30 is optional.

The lifting device 17 also comprises a catch or locking mechanism 35, which is designed to lock the top dishware receptacle 11 during raising or lowering of the bottom dishware receptacle 10 such that the top dishware receptacle 11 is fixed in the washing container 2 in a linearly immovable manner so that it can now be moved only slightly in the extraction direction A and in the insertion direction E for the purpose of operating the lifting device 17. In particular, the locking mechanism 35 is designed to release the top dishware receptacle 11 only when the bottom dishware receptacle 10 is located in the start position $P_A$. The locking mechanism 35 can comprise a locking element 36. The locking mechanism 35 is designed to lock the top dishware receptacle 11 electromechanically in the washing container 2. For instance, the locking mechanism 35 can have a solenoid, which is designed to displace the locking element 36, which may be a pin for example, in order to engage the locking element interlockingly with a mating segment provided on the rear wall 7 of the washing container 2. The locking element 36 may also be an electromagnet, which is designed to connect the locking mechanism 35 securely to the rear wall 7.

The lifting device 17 also comprises a spring mechanism 37, which connects the locking mechanism 35 to the top dishware receptacle 11. The spring mechanism 37 may be a cylinder spring, for example. The spring mechanism 37 is arranged between the rear wall 34 of the top dishware receptacle and a rear wall 38 of the locking mechanism 35. For instance, the spring mechanism 37 can be fixed to the rear walls 34, 38.

FIGS. 1 to 7, to which reference is made, are used below to explain how the lifting device 17 works. To move the bottom dishware receptacle 10 from the start position $P_A$ into the end position $P_E$, the bottom dishware receptacle 10 is first moved out fully from the washing container 2 so that the bottom dishware receptacle 10 is in the start position $P_A$. Suitable sensors can be used to identify whether the bottom dishware receptacle 10 is moved out fully from the washing container 2. The controller 25 is then designed to control the drive mechanism 24 to raise or lower the bottom dishware receptacle 10 during manual movement of the top dishware receptacle 11 in the washing container 2.

Initially, a first manual actuating force $F_1$, in particular a pushing force, is applied to the top dishware receptacle 11 inserted in the washing container 2. The actuating force $F_1$ acts towards the rear wall 7. In this phase, the locking mechanism 35 is still spaced away from the rear wall 7 of the washing container 2, and the top dishware receptacle 11 is not yet locked in the washing container 2. The locking mechanism 35 is not locked. By applying the actuating force $F_1$, the top dishware receptacle 11 is moved further into the washing container 2 until the locking mechanism 35 makes contact with the rear wall 7. The locking mechanism 35 is still not locked yet.

A further inwards movement of the top dishware receptacle 11 into the washing container 2 compresses the spring mechanism 37. During this process, the actuating force $F_1$ acts against a spring force of the spring mechanism 37. The locking mechanism 35 is actuated as soon as a travel distance of the top dishware receptacle 11 is less than a lower threshold value, and the locking element 36 connects the locking mechanism 35 to the rear wall 7 of the washing container 2. In addition, as soon as the locking mechanism 35 is locked, the drive mechanism 24 is controlled by the controller 25 to raise the bottom dishware receptacle 10 out of the start position $P_A$ into the end position $P_E$.

The smaller the travel distance and/or the greater the actuating force $F_1$, the greater is a speed of movement during raising of the bottom dishware receptacle 10. The condition required for locking of the top dishware receptacle 11 and activation of the drive mechanism 24 is that the bottom dishware receptacle 10 is fully extracted. This is ensured by the previously described sensors. The bottom dishware receptacle 10 stays in its present position as soon as the actuating force $F_1$ is no longer applied to the top dishware receptacle 11. A locking mechanism, for instance a self-locking worm gear assigned to the drive mechanism 24, can be provided for this purpose for locking the bottom dishware receptacle 10.

If a second manual actuating force $F_2$, in particular a pulling force, directed away from the rear wall 7, is applied to the locked top dishware receptacle 11, and the travel distance exceeds an upper threshold value, the bottom dishware receptacle 10 is lowered from the end position $P_E$ into the start position $P_A$. As soon as the bottom dishware receptacle 10 has reached the start position $P_A$, the locking mechanism 35 is unlocked or released, so that the top dishware receptacle 11 is no longer locked in the washing container 2 and can be moved out of said washing container. While the top dishware receptacle 11 is locked and no actuating force $F_1$, $F_2$ is being exerted thereon, then the drive mechanism 24 is deactivated and the bottom dishware receptacle 10 remains in its present position. The drive mechanism 24 can comprise the previously mentioned self-locking worm gear for this purpose.

The lifting device 17 also comprises a sensor device 39 for directly detecting the actuating force $F_1$, $F_2$. The sensor device 39 can be provided on the washing container 2, on the top dishware receptacle 11 or on the handle 12 of the top dishware receptacle 11. The sensor device 39 is preferably operatively connected to the handle 12 so that the actuating force $F_1$, $F_2$ can be detected as soon as it is applied to the handle 12. The sensor device 33 can be designated the first sensor device 33, and the sensor device 39 can be designated the second sensor device 39.

Unlike conventional solutions, the lifting device 17 has the advantage that a user does not need to bend down to the bottom dishware receptacle 10 in order to operate the lifting device 17. The lifting device 17 can be operated always at the top dishware receptacle 11 irrespective of the position of the bottom dishware receptacle 10. The lifting device 17 is operated in particular using the handle 12 of the top dishware receptacle 11. There is also no need to fit to the dishwashing machine 1 additional buttons or sensor panels for operating the lifting device 17. The fact that the lifting device 17 can be activated to raise or lower the bottom dishware receptacle 10 only when the top dishware receptacle 11 is located fully in the washing container 2 prevents the bottom dishware receptacle 10 from colliding with the top dishware receptacle 11. There is also no need to transfer data and/or energy into the washing chamber 4 of the washing container 2.

Figure 4:
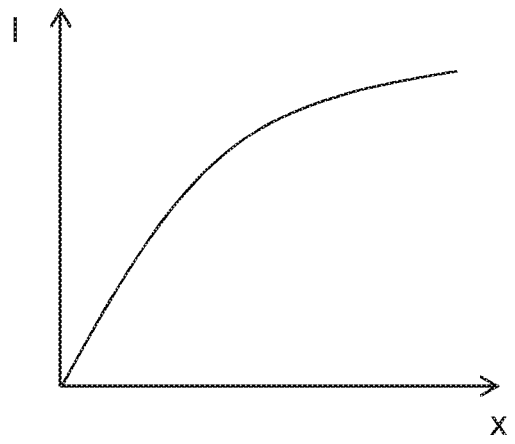
FIG. 4 shows a diagram for illustrating the travel-dependent current draw of the electrical drive mechanism of the lifting device of FIG. 1.

The drive mechanism 24 shown in FIG. 3 comprises a detection unit 40, which is designed to detect an instantaneous current draw of the electrical drive mechanism 24 over a travel distance x of the dishware receptacle 10 in the dishwashing machine 1. In this connection, FIG. 4 shows a graph for illustrating the travel-dependent current draw I of the electrical drive mechanism 24 of the lifting device 17.

In addition, the controller 25 comprises an identification unit 41 for identifying at least one status of the lifting device 17 on the basis of the current draw I of the electrical drive mechanism 24 detected over the travel distance x.

Examples of the at least one status that can be identified by the identification unit 41 are the position of the bottom dishware receptacle 10 in the washing container 2, a fault condition of the lifting device 17 and a present weight of a load accommodated in the bottom dishware receptacle 10.

Figure 5:
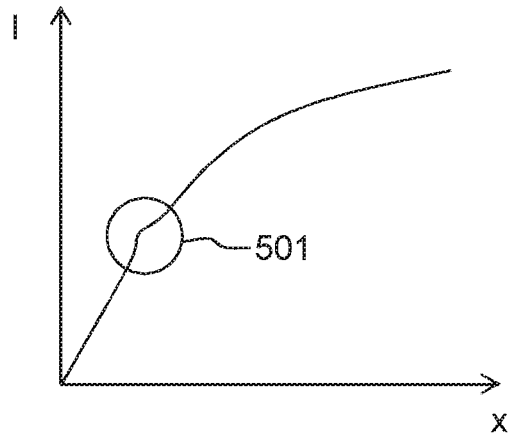
FIG. 5 shows a diagram for illustrating the travel-dependent current draw of the electrical drive mechanism of the lifting device in the event of a fault condition.

The identification unit 41 is designed, for example, to identify a fault condition of the lifting device 17 on the basis of a first derivative of the detected current draw I with respect to the travel distance x. In this connection, FIG. 5 shows a graph for illustrating the travel-dependent current draw I of the electrical drive mechanism 24 in the event of a fault condition, which is highlighted in detail by the circle 501 in FIG. 5. The gradient of the instantaneous current draw I varies in the region of the circle 501. This variation in the gradient can be identified particularly easily by the first mathematical derivative of the detected current draw I with respect to the travel distance x. In other words, the fault condition is detected by means of the derivative of the motor current of the electrical drive mechanism 24 with respect to the distance x. For example, if during the movement of the bottom dishware receptacle 10, the current I or the current draw I deviates from a reference curve or standard curve, for instance if a child becomes caught on the bottom dishware receptacle, this is detected, and the controller 24 can respond accordingly, for instance by switching off the drive mechanism 24 or reversing the bottom dishware receptacle 10.

Figure 6:
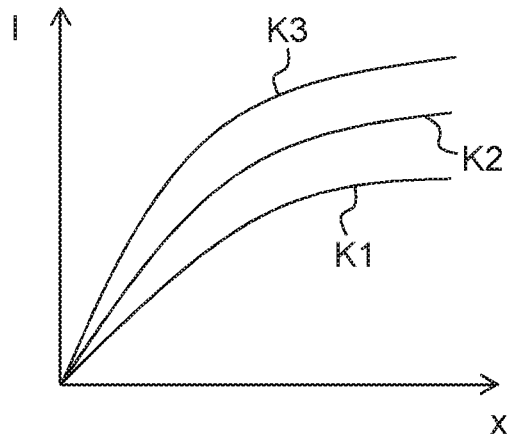
FIG. 6 shows a diagram for illustrating different weight-specific reference curves for the current draw of the electrical drive mechanism.
Figure 7:
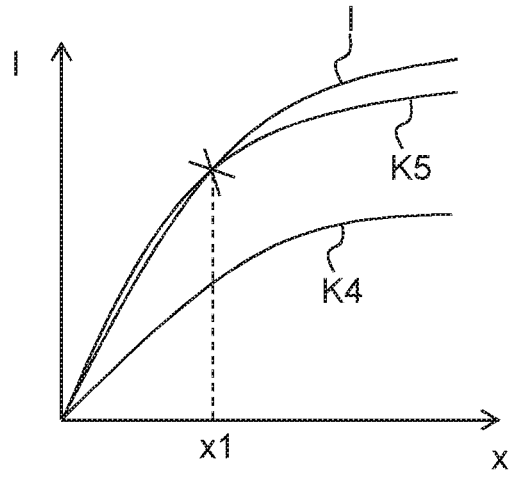
FIG. 7 shows a diagram for illustrating an example of the travel-dependent current draw of the electrical drive mechanism of the lifting device, and also a minimum reference curve for a minimum current draw of the electrical drive mechanism and a maximum reference curve for a maximum current draw of the electrical drive mechanism.

The identification unit 41 can also be designed to identify the at least one status of the lifting device 17 on the basis of a comparison of the current draw I detected over the travel distance x with at least one reference curve K1-K5 for the current draw I of the electrical drive mechanism 24. FIGS. 6 and 7 show examples relating to this.

FIG. 6 shows a graph for illustrating different weight-specific reference curves K1, K2 and K3 for the current draw of the electrical drive mechanism 24. In this case, the reference curve K1 is an example of a light load, the reference curve K2 is an example of a moderately heavy load, and the reference curve K3 is an example of a heavy load. The weight-specific reference curves K1-K3 are stored in a memory unit 42, for example, which is integrated in the controller 25, for instance. The identification unit 41 can be designed to identify the present weight of the load accommodated in the bottom dishware receptacle 10 by comparing the actually detected current draw I with the weight-specific reference curves K1-K3. The reference curve K1, K2 or K3 that is currently effective is inferred from the actually detected current draw I. The present weight of the load is then deduced by means of the reference curve K1, K2 or K3 selected in this manner.

In addition, it is also possible to use a weight sensor (not shown). The weight sensor can be designed to determine a present weight of the load accommodated in the bottom dishware receptacle 10. In addition, a selection unit 43 integrated in the controller 25 can be designed to select one of the stored reference curves K1-K3 on the basis of the weight of the load determined by the weight sensor. The identification unit 41 can be designed in this case to identify a fault condition of the lifting device 17 by comparing the actually detected current draw I with the selected reference curve K1, K2 or K3. In this embodiment, the selected reference curve K1, K2 or K3 defines a reference-value characteristic, whereas the actually detected current draw I constitutes an actual-value characteristic. A fault condition of the lifting device 17 can be detected on the basis of a deviation of the actual-value characteristic from the reference-value characteristic.

Furthermore, the information content for detecting a status of the lifting device 17 can be increased by using the weight of the load determined by the weight sensor. In this case, the identification unit 41 can be designed to identify the at least one status of the lifting device 17 on the basis of the detected current draw I and the weight determined by the weight sensor.

In addition, FIG. 7 shows a graph for illustrating an example of the travel-dependent current draw I of the electrical drive mechanism 24, and also a minimum reference curve K4 for a minimum current draw of the electrical drive mechanism 24 and a maximum reference curve K5 for a maximum current draw of the electrical drive mechanism 24. In this case, the identification unit 41 is designed to ascertain a fault condition of the lifting device 17 if the detected current draw is less than the stored minimum reference curve K4 or greater than the stored maximum reference curve K5. In the example of FIG. 7, the actually detected current draw I intersects the maximum reference curve K5 at the travel distance x1 given by way of example. It is hence ascertained that a fault condition exists at the travel distance x1. The controller 25 can respond to this detected fault condition, for example, by using the lifting device 17 to reverse the bottom dishware receptacle 10.

Figure 8:
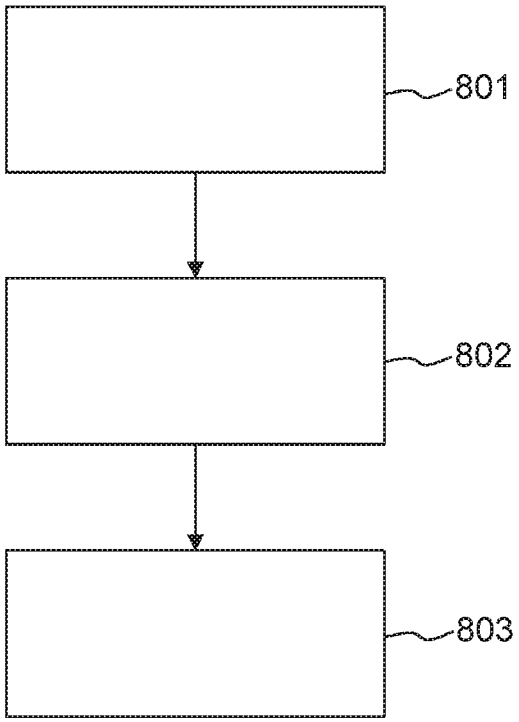
FIG. 8 shows an exemplary embodiment of a method for operating a lifting device for a dishwashing machine.

FIG. 8 shows an exemplary embodiment of a method for operating a lifting device 17 for a dishwashing machine 1. An example of such a lifting device is shown in FIGS. 1 and 2. The dishwashing machine 1 is a domestic dishwashing machine, for example, and comprises a dishware receptacle 10. The lifting device 17 comprises an electrical drive mechanism 24, which is designed to move the dishware receptacle 10 between a start position $P_A$ and an end position $P_E$ by means of raising or lowering. The example of the method in FIG. 8 comprises the following steps 801, 802 and 803:

In step 801, a travel distance x of the dishware receptacle 10 in the dishwashing machine 1 is detected.

In step 802, a current draw I of the electrical drive mechanism 24 is detected over the travel distance x.

In step 803, at least one status of the lifting device 17 is identified on the basis of the current draw I of the drive mechanism 24 detected over the travel distance x.

Although the present invention has been described with reference to exemplary embodiments, it can be modified in numerous different ways. For instance, FIGS. 1 and 2 show a dishwashing machine 1 having a bottom dishware receptacle 10 and a top dishware receptacle 11. The lifting device 17 can also be used for a dishwashing machine having just one dishware receptacle.

LIST OF REFERENCES USED

1 dishwashing machine
2 washing container
3 door
4 washing chamber
5 floor
6 ceiling
7 rear wall
8 side wall
9 side wall
10 dishware receptacle
11 dishware receptacle
12 handle
13 guidance mechanism
14 guide rail
15 guide rail
16 running rail
17 lifting device
18 pivoting arm
19 pivoting arm
20 bearing
21 bearing
22 bearing
23 bearing
24 electrical drive mechanism
25 controller
26 control line
27 side wall
28 housing
29 drive shaft
30 drag lever
31 bearing
32 bearing
33 sensor device
34 rear wall
35 locking mechanism
36 locking element
37 spring mechanism
38 rear wall
39 sensor device
40 detection unit
41 identification unit
42 memory unit
43 selection unit
501 circle
801 method step
802 method step
803 method step
A extraction direction
E insertion direction
$F_1$ actuating force
$F_2$ actuating force
I current draw
K1 weight-specific reference curve
K2 weight-specific reference curve
K3 weight-specific reference curve
K4 minimum reference curve
K5 maximum reference curve
$P_A$ start position
$P_E$ end position
x travel distance

The invention claimed is:

1. A lifting device for a dishwashing machine, comprising:

an electrical drive mechanism constructed to move a dishware receptacle of the dishwashing machine between a start position and an end position;

a detection unit configured to detect a current draw of the electrical drive mechanism over a travel distance of the dishware receptacle in the dishwashing machine; and an identification unit configured to identify a status of the lifting device on the basis of the current draw of the electrical drive mechanism detected over the travel distance.

2. The lifting device of claim 1, constructed for a domestic dishwashing machine.

3. The lifting device of claim 1, wherein the identification unit is configured to identify on the basis of the current draw of the drive mechanism detected over the travel distance, a position of the dishware receptacle in a washing container of the dishwashing machine, a fault condition of the lifting device and/or a present weight of a load accommodated in the dishware receptacle.

4. The lifting device of claim 1, wherein the identification unit is configured to identify a fault condition of the lifting device on the basis of a derivative of the detected current draw with respect to the travel distance.

5. The lifting device of claim 1, wherein the identification unit is configured to identify the status of the lifting device on the basis of a comparison of the current draw detected over the travel distance with at least one reference curve for the current draw of the electrical drive mechanism.

6. The lifting device of claim 1, further comprising a memory unit configured to store a multiplicity of different reference curves for the current draw of the electrical drive mechanism, which reference curves are weight-specific for a load of the dishware receptacle, said identification unit being configured to identify a present weight of the load accommodated in the dishware receptacle by comparing the detected current draw with the weight-specific reference curves.

7. The lifting device of claim 1, further comprising:

a memory unit configured to store a multiplicity of different reference curves for the current draw of the electrical drive mechanism, which reference curves are weight-specific for a load of the dishware receptacle;

a weight sensor configured to determine a present weight of the load accommodated in the dishware receptacle; and a selection unit configured to select one of the stored reference curves on the basis of the weight of the load determined by the weight sensor, wherein the identification unit is configured to identify a fault condition of the lifting device by comparing the detected current draw with the selected reference curve.

8. The lifting device of claim 1, further comprising a weight sensor configured to determine a weight of a load accommodated in the dishware receptacle, said identification unit being configured to identify the status of the lifting device on the basis of the detected current draw and the weight determined by the weight sensor.

9. The lifting device of claim 1, further comprising a sensor device configured to detect the travel distance of the dishware receptacle in the dishwashing machine.

10. The lifting device of claim 1, further comprising a memory unit configured to store a minimum reference curve for a minimum current draw of the electrical drive mechanism and a maximum reference curve for a maximum current draw of the electrical drive mechanism, said identification unit being configured to ascertain a fault condition of the lifting device when the detected current draw is less than the stored minimum reference curve or greater than the stored maximum reference curve.

11. The lifting device of claim 1, further comprising a controller configured to control the electrical drive mechanism for raising or lowering the dishware receptacle according to the identified status of the lifting device.

12. The lifting device of claim 11, wherein the identification unit is integrated in the controller.

13. The lifting device of claim 1, wherein the electrical drive mechanism includes a servomotor.

14. The lifting device of claim 9, wherein the dishware receptacle of the dishwashing machine is a bottom dishware receptacle in spaced-apart relation to a top dishware receptacle of the dishwashing machine, said electrical drive mechanism being configured to move the bottom dishware receptacle of the dishwashing machine between the start position and the end position, said sensor device being configured to detect the travel distance of the bottom dishware receptacle in the dishwashing machine, said detection unit being configured to detect the current draw of the electrical drive mechanism over the travel distance of the bottom dishware receptacle, said identification unit being configured to identify the status of the lifting device on the basis of the current draw of the electrical drive mechanism detected over the travel distance of the bottom dishware receptacle.

15. A dishwashing machine, comprising:

a washing container;

a dishware receptacle configured for arrangement in the washing container; and a lifting device comprising an electrical drive mechanism constructed to move the dishware receptacle between a start position and an end position, a detection unit configured to detect a current draw of the electrical drive mechanism over a travel distance of the dishware receptacle in the washing container, and an identification unit configured to identify a status of the lifting device on the basis of the current draw of the electrical drive mechanism detected over the travel distance.

16. The dishwashing machine of claim 15, constructed in the form of a domestic dishwashing machine.

17. A method for operating a lifting device for a dishwashing machine, comprising:

detecting a travel distance of a dishware receptacle in the dishwashing machine as the dishware receptacle is moved by an electrical drive mechanism of the lifting device between a start position and an end position;

detecting a current draw of the electrical drive mechanism over the travel distance; and identifying a status of the lifting device on the basis of the current draw of the electrical drive mechanism detected over the travel distance.

* * * * *